United States Patent [19]

Meneely

[11] Patent Number: 4,741,307

[45] Date of Patent: May 3, 1988

[54] APPARATUS AND METHOD FOR COMPRESSION RELEASE RETARDING OF AN ENGINE

[75] Inventor: Vincent A. Meneely, Langley, Canada

[73] Assignee: Pacific Diesel Brave Co., Surrey, Canada

[21] Appl. No.: 15,683

[22] Filed: Feb. 17, 1987

[51] Int. Cl.[4] ..... F22B 21/00

[52] U.S. Cl. ..... 123/321; 123/90.12; 123/90.13; 123/347

[58] Field of Search ..... 123/90.12, 90.13, 90.15, 123/198 F, 198 DB, 321, 347

[56] References Cited

U.S. PATENT DOCUMENTS

| | | | |
|---|---|---|---|
| 4,395,884 | 8/1983 | Price | 60/602 |
| 4,474,006 | 10/1984 | Price et al. | 60/602 |
| 4,510,900 | 4/1985 | Quenneville | 123/321 |
| 4,592,319 | 6/1986 | Meistrick | 123/321 |
| 4,655,178 | 4/1987 | Meneely | 123/321 |

*Primary Examiner*—Stephen F. Husar

*Attorney, Agent, or Firm*—Bull, Housser & Tupper

[57] ABSTRACT

There is provided a method and apparatus for compression release retarding of an internal combustion engine. The apparatus opens an exhaust valve of each cylinder of the engine during a compression stroke and near the top dead center position. An exhaust valve of a second cylinder is open while the exhaust valve of the first cylinder is so open, the second cylinder being on its intake stroke. The apparatus may open the normally closed exhaust valves of a set of cylinders for a period of time when any of the cylinders is near the top dead center position following its compression stroke, during this time at least one of the cylinders of the set being on its intake stroke and all of the cylinders of the set being on the exhaust stroke, the intake stroke or the expansion stroke.

42 Claims, 4 Drawing Sheets

APPARATUS AND METHOD FOR COMPRESSION RELEASE RETARDING OF AN ENGINE

BACKGROUND OF THE INVENTION

The invention relates to an apparatus and method for retarding vehicles powered by internal combustion engines, typically diesel engines, by releasing compressed gases from each cylinder through its exhaust valve during a compression stroke and near the top dead centre position and during the same time opening the exhaust valve of a cylinder on an intake stroke.

Truckers commonly encounter the problem of slowing heavy trucks, usually diesel powered trucks, on long down-grades. It is well known that excessive use of conventional brakes leads to premature brake wear and to overheating of the brakes. Consequently it is well known to fit diesel engines with compression release retarding devices which slow the trucks due to the action of the compression of their engines. It is commonly assumed that the high compression of a diesel engine yields significant braking effect when the accelerator is released, and the fuel supply thereby reduced, while coasting down hill. However, one must consider the rebound effect of the compressed gases in each cylinder following the compression stroke and prior to the expansion stroke. The compression stroke may be likened to a spring, each piston acting against the spring to slow the vehicle on its compression stroke. However, the compressed "spring" stores energy which acts against the piston to accelerate the vehicle on the expansion stroke even though the fuel supply has been cut. The previously known retarding devices crack open the exhaust valve of each cylinder during the compression stroke and near the top dead centre position. The compressed gases are thereby discharged through the exhaust system of the engine and have no rebound effect on the piston.

Conventionally, for engines having a push rod or push tube actuated fuel injector, the force to crack open each exhaust valve may be provided by a slave hydraulic piston coupled in a closed hydraulic circuit with a master hydraulic piston actuated by the push rod or push tube for the fuel injector. One problem, however, was to provide a suitably timed pulse of high pressure hydraulic fluid to depress the exhaust valves for engines not equipped with fuel injector push rods or push tubes. Various arrangements have been suggested which involve complicated hydraulic plumbing in some cases.

Patents have been issued for related devices including the following United States patents assigned to Jacobs Manufacturing Company: U.S. Pat. Nos. 4,592,319; 4,399,787; 4,398,510; 4,473,047; 4,423,712; 4,395,884; 4,474,006; 4,485,780; 4,510,900 and 4,572,114.

However, even in view of these prior art devices, the need exists for a relatively simple and reliable retarding device capable of operation on engines without fuel injector push rods and which, at the same time, offers improved performance over conventional units.

SUMMARY OF THE INVENTION

The invention provides a method for compression release retarding of a four cycle, multi-cylinder, internal combustion engine. The method includes the steps of opening at least one exhaust valve of a first cylinder of the engine for a period of time beginning each time the first cylinder is on a compression stroke and near the top dead centre position. At least one exhaust valve of a second cylinder of the engine is opened while the second cylinder is on its intake stroke and during each period of time when said at least one exhaust valve of the first cylinder is open.

The exhaust valves of the first and second cylinders may be opened and closed simultaneously during each period of time.

The method may also include the step of restricting the flow of exhaust gas from the engine.

The invention also provides an apparatus for compression release retarding of a four cycle, multi-cylinder internal combustion engine wherein each said cylinder has a piston and an exhaust valve. The apparatus comprises means for opening the exhaust valves of a plurality of the cylinders of the engine for periods of time beginning each time one of the cylinders is on a compression stroke and near a top dead centre position. The piston of another of the plurality of cylinders is on an intake stroke during each period of time.

In a preferred form, the means for opening is operable on the exhaust valves of three cylinders of the engine, the third of the three cylinders being on an exhaust stroke and the exhaust valve of the third cylinders being normally open during each period of time. The engine may be a six cylinder engine. The apparatus then includes two said means for opening, each being operable on the exhaust valves of three of the cylinders.

The means for opening may include at least one valve depressing hydraulic actuator capable of depressing the exhaust valves of the plurality of cylinders a small distance relative to normal, maximum valve movement.

The means for opening may also include a hydraulic pumping device and means for operating the pumping device to supply pressurized fluid during the period of time.

For example, the hydraulic pumping device may be an hydraulic pulse generator operated by a cam rotated by a power take-off of the engine.

Alternatively, the means for opening may include means for storing pressurized hydraulic fluid, a first hydraulic fluid conduit extending from the means for storing to said at least one hydraulic actuator and means along the conduit for providing a release of the pressurized hydraulic fluid through the conduit towards said at least one hydraulic actuator when any of the plurality of cylinders is on a compression stroke and near the top dead centre position.

The means for opening in this case may also include a hydraulic fluid pumping means for providing pressurized hydraulic fluid to the means for storing. The hydraulic fluid pumping means may be a piston type pump actuated by valve opening components of the engine.

The means for providing a release of the pressurized fluid may include means for timing the release of hydraulic fluid in the form of a timing valve activated by movement of the valve opening components. The hydraulic fluid may be released towards the one or more hydraulic actuators when any of the exhaust valves of the plurality of cylinders is opened substantially fully by conventional valve opening components of the engine.

Briefly, the invention provides the advantages of a simplified system resulting from the fact that the exhaust valves of a plurality of cylinders can be cracked open at the same time. Furthermore, improved retarding results from cracking open the exhaust valve of a cylinder on each intake stroke and diverting into it a pressure wave emanating from the cylinder on the compression stroke to increase the charge on the intake stroke and thereby increase the braking effect during the subsequent compression stroke.

DESCRIPTION OF THE PREFERRED EMBODIMENTS

Figure 1:
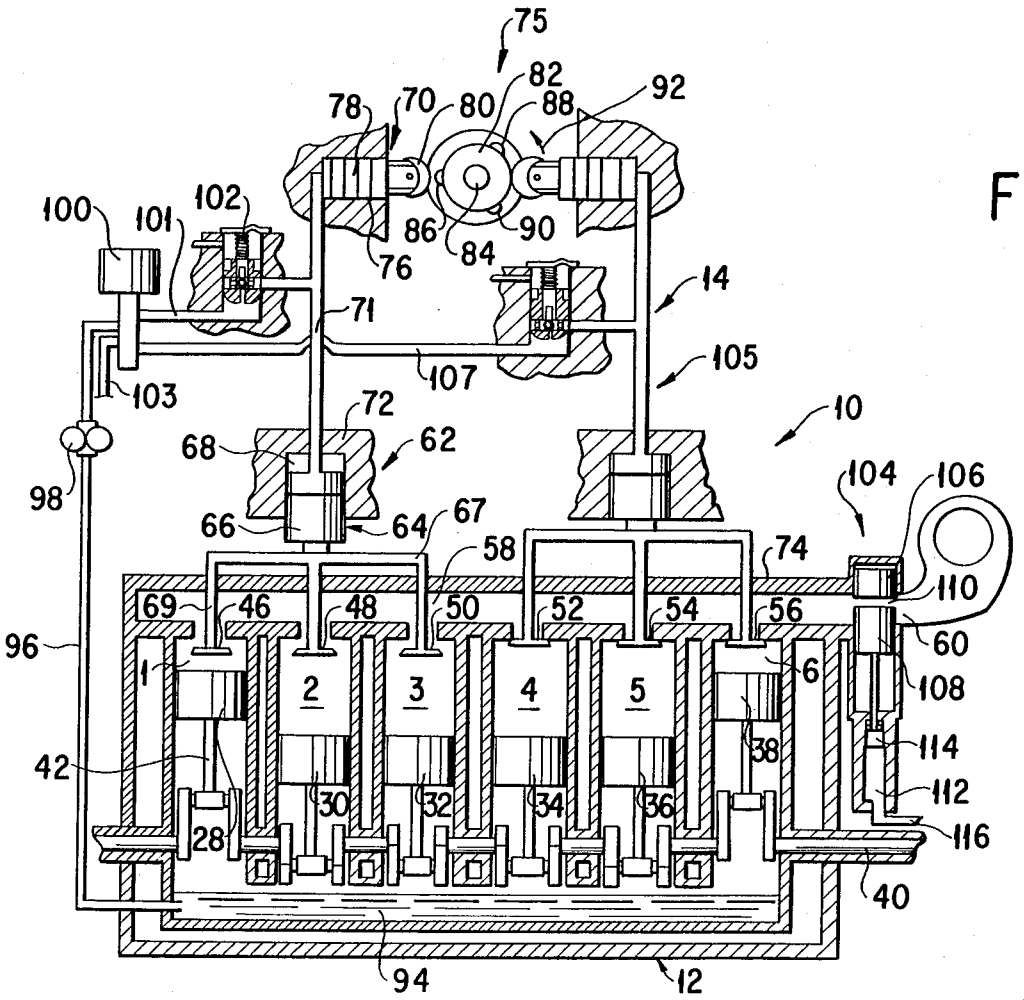
FIG. 1 is a simplified, sectional elevation of a diesel engine and an apparatus for compression release retarding of the engine according to a first embodiment of the invention.

Referring firstly to FIG. 1, this shows a combination 10 of an engine 12 and an apparatus 14 for compression release retarding of the engine. The engine is a four cycle, multi-cylinder internal combustion engine. In this case, the engine is of the compression ignition type, commonly known as a Diesel engine, and has six cylinders, conventionally numbered 1, 2, 3, 4, 5 and 6. The cylinders may be regarded as being in two sets, the first set being cylinders 1, 2 and 3 and the second set being cylinders 4, 5 and 6. In the conventional manner, each cylinder is fitted with a reciprocable piston, the cylinders 1, 2, 3, 4, 5 and 6 having pistons 28, 30, 32, 34, 36 and 38 respectively. Again in the conventional manner, each piston is connected to a crankshaft 40 by a connecting rod, such as connecting rod 42 for piston 28.

The sets of cylinders are chosen such that when the piston of one of the cylinders of the set is on a compression stroke and near the top dead centre position, for example piston 28 of cylinder 1, at least one other piston of the set is on the intake stroke, for example piston 32 of cylinder 3. Those cylinders whose pistons are not at the top dead centre position following the compression stroke or on the intake stroke at the time are on the exhaust stroke as, for example, piston 30 of cylinder 2. In short, when any of the three cylinders 1, 2 or 3 is on a compression stroke near the top dead centre position, one of the other cylinders is on the intake stroke and the other cylinder is on the exhaust stroke.

The set of cylinders 4, 5 and 6 behave in a similar manner. In the position shown in FIG. 1, however, none of the cylinders 4, 5 or 6 is near the top dead centre of a compression stroke. Cylinder 6 is near top dead centre but is on the exhaust stroke.

Each of the cylinders is provided with one or more exhaust valves. In this case only one exhaust valve is illustrated for each cylinder although, in many diesel engines, two exhaust valves are provided, the valve stems or tubes being connected by a crosshead for simultaneous opening of the valves. Therefore it should be understood that references herein to an exhaust valve for each cylinder also means two exhaust valves for such engines. Cylinders 1, 2, 3, 4, 5 and 6 are provided with exhaust valves 46, 48, 50, 52, 54 and 56 respectively. The cylinders communicate through the open exhaust valves with a common exhaust manifold 58 leading to an exhaust outlet 60.

The apparatus 14 includes a first device 62 for opening the exhaust valves 46, 48 and 50 of cylinders 1, 2 and 3 which are normally closed during periods of time beginning on each compression stroke of each cylinder near the top dead centre position. For example, device 62 opens those exhaust valves 46, 48 and 52 which are normally closed, as illustrated in FIG. 1, when piston 28 is near its top dead centre position during a compression stroke. This in fact means that valves 46 and 50 only are opened by device 62 because valve 48 is opened normally at the time. The device functions in a similar manner when cylinders 2 and 3 are on the compression stroke and near the top dead centre position. Similarly, device 62 serves to allow the valves to close together.

Device 62 includes a valve depressing hydraulic actuator 64 in the form of a slave cylinder which includes a piston 66 reciprocable in a cylinder 68. As illustrated, piston 66 bears against a connecting member 67 shown schematically bearing against the valve stems of each of the valves 46, 48 and 50, such as valve stem 69 of valve 46. Alternatively, three separate slave pistons and cylinders could be used, one acting on each of the valves. In that case, the cylinders would be connected together in parallel to a common hydraulic fluid conduit. In the illustrated example, cylinder 68 is connected to hydraulic fluid conduit 71. The cylinder 68 is contained within a housing 72 connected to a valve cover mount 74 of the engine.

Apparatus 14 includes an hydraulic pulse generator shown generally at 75. Conduit 71 is connected to a piston-type pump 70 having a master cylinder 76 with a piston 78. A cam follower 80 is mounted on the exposed end of piston 78 and contacts a rotatable cam 82 connected to a power take-off 84 of the engine. The cam has three lobes 86, 88 and 90, the piston 78 being depressed to the left, from the point of view of FIG. 1, when each of the lobes 86, 88 and 90 contacts cam follower 80. Lobe 86 depresses the piston as illustrated to open valves 46 and 50 when piston 28 is on a compression stroke and near the top dead centre position. As mentioned valve 48 is normally open then. Cam 82 is rotated in the direction illustrated by arrow 92 at half engine speed so lobe 88 depresses master piston 78 and thus slave piston 66 to open the exhaust valves 46, 48 and 50 each time piston 28 is in this position on the compression stroke near the top dead centre position. Likewise, lobe 90 is used to open the exhaust valves 46, 48, and 50 each time piston 30 is at this position.

The engine 10 has a sump 94. A conduit 96 extends to the sump. The engine oil pump 98 pumps oil from the sump to serve as hydraulic fluid for apparatus 14. In the manner conventional for such retarding devices, a solenoid valve 100 is connected to a switch in the cab of the truck and is opened to allow a flow of oil through conduit 101 to conduit 71 via check valve 102 and thus to apparatus 14. Check valve 102 serves to permit a flow of fluid towards conduit 71, but prevents a return flow of fluid to the sump when piston 78 is depressed by the cam. When the switch is the cab is opened a return flow of fluid from the apparatus 14 to the sump occurs through valve 100 to drain 103. Apparatus 14 operates as a closed hydraulic system when operational. The depression of master piston 78 forces hydraulic fluid through the conduit 71 to slave cylinder 68, depressing piston 66 and thus opening those exhaust valves 46, 48 and 50 which are closed.

The combination 10 includes a second device 105 for opening those of valves 52, 54 and 56 which are normally closed when one of the cylinders 4, 5 or 6 is on the compression stroke and near the top dead centre position. Device 105 is the same as device 62 and thus is not described in detail. It is connected to solenoid valve 100 by a conduit 107.

The combination is also provided with a device 104 for restricting the flow of exhaust gases from exhaust outlet 60. The device is in the form of a gate valve 106 having a gate 108 with an aperture 110. The gate 108 is movable into a position, as illustrated in FIG. 1, to partially block the flow of exhaust gases through the conduit 60. The gate 108 is reciprocated into position as shown by a pneumatic cylinder 112 provided with a piston 114 connected to a conduit 116 for supplying pressurized air when the vehicle is coasting and the apparatus 14 is operational.

Figure 2:
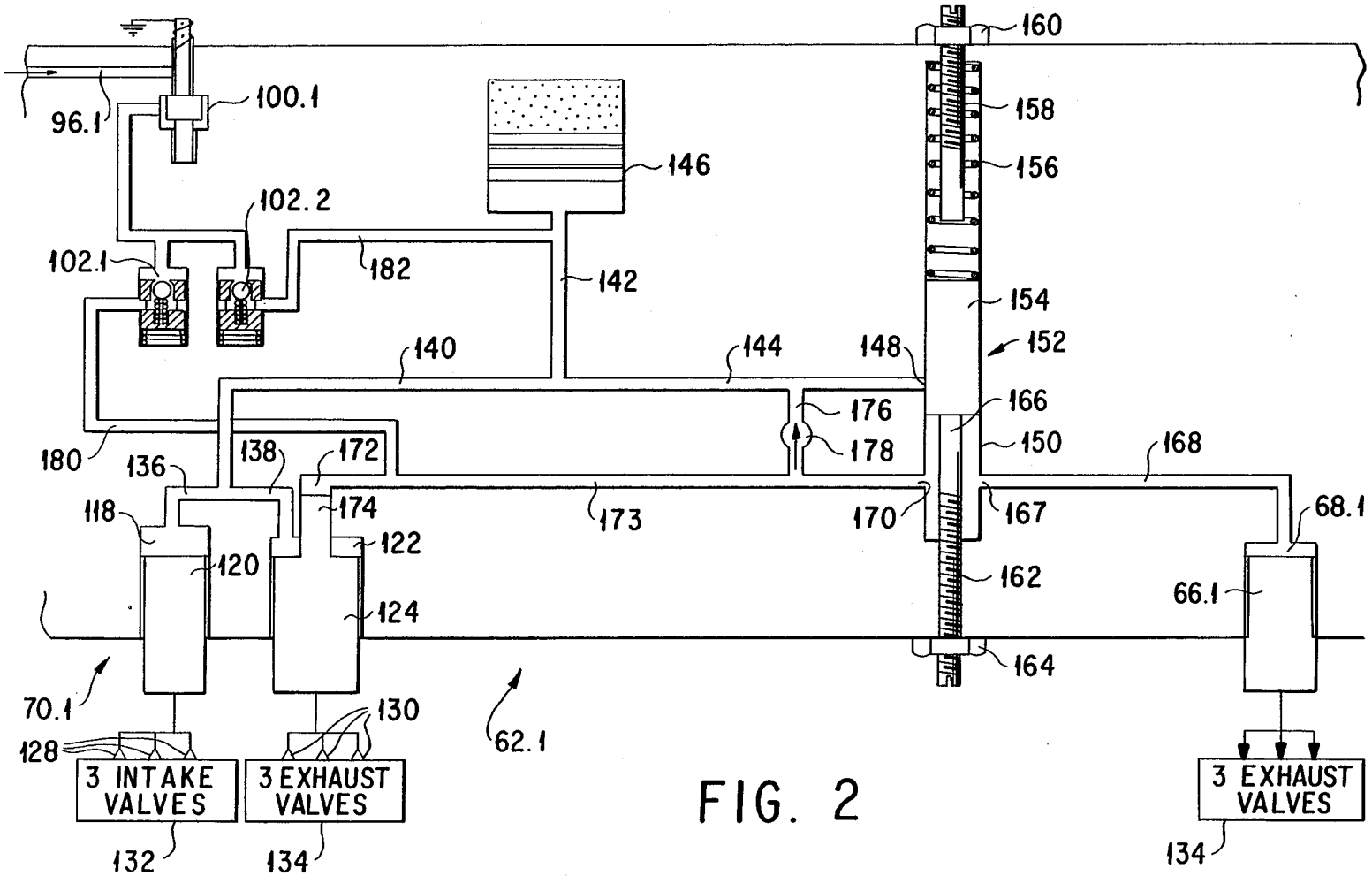
FIG. 2 is a diagrammatic view of an apparatus for retarding an engine according to another embodiment of the invention.

An alternative embodiment of the invention is shown in FIG. 2 which illustrates an apparatus 62.1. In this embodiment, piston 66.1 and cylinder 68.1 serve a function similar to piston 66 and cylinder 68 shown in FIG. 1. Piston 66.1 acts as a slave piston for depressing simultaneously three exhaust valves 134 represented schematically and equivalent to valves 46, 48 and 50 shown in FIG. 1. Solenoid 100.1, equivalent to solenoid 100 of FIG. 1, and check valves 102.1 and 102.2, equivalent to check valve 102, are used in this embodiment. A conduit 96.1, equivalent to conduit 96, extends to the sump of the engine and provides oil acting as a hydraulic fluid.

In the embodiment of FIG. 2, the pulse pump 70.1 is a dual master cylinder arrangement including a first cylinder 118 provided with a piston 120 and a second cylinder 122 provided with a piston 124. The pistons 120 and 124 are actuated by valve opening components for the intake valves 132 and exhaust valves 134 of the cylinders of the respective set. The exact components utilized depend upon the configuration of the engine. For example, the pistons may contact adjusting screws 128 and 130, represented schematically, on rocker arms for intake valves 132 and exhaust valves 134 of a set of cylinders 1, 2 and 3 equivalent to those shown in FIG. 1. Piston 120 is displaced when any of the intake valves are opened and piston 124 is displaced when any of the exhaust valves are opened.

Cylinders 118 and 122 are connected by hydraulic conduits 136 and 138 to an hydraulic conduit 140, which, in turn, branches into conduits 142 and 144. Conduit 142 extends to a gas accumulator 146 which is a conventional component serving as means for storing pressurized hydraulic fluid. Conduit 144 is connected to a port 148 on cylinder 150 of a timing valve 152. Timing valve 152 has a piston 154 resiliently biased by a coil spring 156 towards the bottom end of the cylinder from the point of view of FIG. 2. A bolt 158 threadedly engages the end of cylinder 150 to act as a stop for the piston. The bolt is provided with a nut 160 and is turned in order to adjust the upward limit of piston 154 again according to the arbitrary orientation of valve 152 in FIG. 2. The opposite end of cylinder 150 has a threaded bolt 162 provided with a nut 164. The end 166 of the bolt 162 within the cylinder contacts piston 154 when the piston is displaced the maximum distance under the pressure of spring 156. By rotating bolt 162, the rest position of the piston can be varied. A port 167 of the cylinder 150 communicates with a conduit 168 extending from the timing valve to cylinder 68.1 for supplying pressurized fluid to depress piston 66.1 and thereby open those of exhaust valves 134 which are normally closed. The cylinder has another port 170 connected to a hydraulic conduit 173 which extends from the timing valve to a small cylinder 172 with a small timing piston 174, the latter being connected to piston 124 described previously. Timing valve 152 serves as means for timing the release of hydraulic fluid from the accumulator 146 towards hydraulic cylinder 68.1 so the release occurs when each of the cylinders of the set, equivalent to sets of cylinders 1, 2 and 3 or cylinders 4, 5 and 6 of FIG. 1, is on the compression stroke near the top dead centre position.

The piston 174 and cylinder 172 provide control means operatively communicating with the valve opening components 130 for the exhaust valves 134, by means of piston 124, for supplying pressurized hydraulic fluid to the actuator for the timing valve, namely cylinder 150 and piston 154. When piston 124 is moved by the exhaust valves, that is upward movement from the point of view of FIG. 2, piston 174 is pushed into cylinder 172, driving pressurized hydraulic fluid through conduit 173 into cylinder 150. At the same time, hydraulic fluid displaced by the piston 124 is driven from cylinder 122 through conduit 138 and, together with hydraulic fluid displaced from cylinder 118 by the intake valves 132 flowing from conduit 136, enters gas accumulator 146 through conduits 140 and 142. At the illustrated position in FIG. 2, all of the fluid is directed into the gas accumulator. However, the hydraulic fluid flowing from cylinder 172 through conduit 173 into cylinder 150 acts against piston 154 moving it against the force of spring 156. Movement of piston 154 occurs instead of movement of slave piston 66.1 because the latter has more resistance to movement as it bears against the exhaust valves. This tends to raise the piston from the point of view of FIG. 2. When the piston 154 is raised sufficiently, port 148 is uncovered by the piston 154, allowing a fast flow of pressurized hydraulic fluid from the accumulator 146, through conduits 142 and 144, through cylinder 150 and into conduit 168 to cylinder 68.1. This quick release of pressurized fluid moves piston 66.1 downwardly against the exhaust valves 134 to crack open the closed valves of the same. The piston 154 moves sharply against bolt 158 which acts as a stop, limiting upward movement of the piston and pressure loss due to piston displacement.

Only the conventional valve opening components for one of the intake valves 132 and one of the exhaust valves 134 actually act against the master pistons 120 and 124 at a given time. When these valves begin to close, pistons 120 and 124 move downwardly from the point of view of FIG. 2, under the action of the pressurized hydraulic fluid, allowing fluid to flow back to the cylinders 118 and 122 through conduit 168 to cylinder 150 and then chiefly through port 148 and conduits 144 and 140. Thus piston 66.1 is raised under the force of the valve springs and exhaust valves 134 close. As the pressure in cylinder 150 is reduced, piston 154 will be moved by the action of spring 156 and eventually close port 148. When this occurs, fluid continues to flow through port 170 and conduit 173 to cylinder 172. However, this cylinder does not have the volume to accommodate all the remaining fluid. For this reason, a conduit 176 is provided between conduits 144 and 173 and is provided with a check valve 178. The check valve permits a flow of hydraulic fluid from conduit 173 to conduit 144 and through conduit 140 back to the cylinders 118 and 122. The check valve, however, prevents a reverse flow of fluid through conduit 176 when the cylinders 118 and 122 are providing pressurized fluid to the accumulator and port 148 is closed.

Conduits 180 and 182 connect check valves 102.1 and 102.2 to conduits 173 and 142 respectively. The check valves and solenoid valve 100.1 serve to provide hydraulic fluid for the system as described in the previous embodiment.

The embodiments described above relate to the illustrated six cylinder in-line engine 12 shown in FIG. 1. Adaptations of the systems can be made for other configurations of engines. As with conventional units, in these systems the exhaust valve of each cylinder is cracked open very briefly and a relatively small amount compared to normal valve movement when each cylinder is on a compression stroke and near the top dead centre position. This releases compressed gases into the exhaust manifold 58 shown in FIG. 1. This is an arrangement in common with the prior art. However, the system also simultaneously opens one other exhaust valve, namely that on a cylinder on the intake stroke. A pressure wave from the cylinder on the compression stroke passes through the manifold and is diverted through the open exhaust valve on that cylinder, for example cylinder 3 of FIG. 1, which is on the intake stroke to increase the charge in that cylinder. This is desirable because the increased charge provides increased compression during the subsequent compression stroke, thus increasing the retarding effect of the engine. The use of the device 104 for restricting a flow of exhaust gases from exhaust conduit 60 can accentuate this effect by diverting more of the gases into the cylinder 3 rather than having them pass out through the exhaust conduit.

Figure 3:
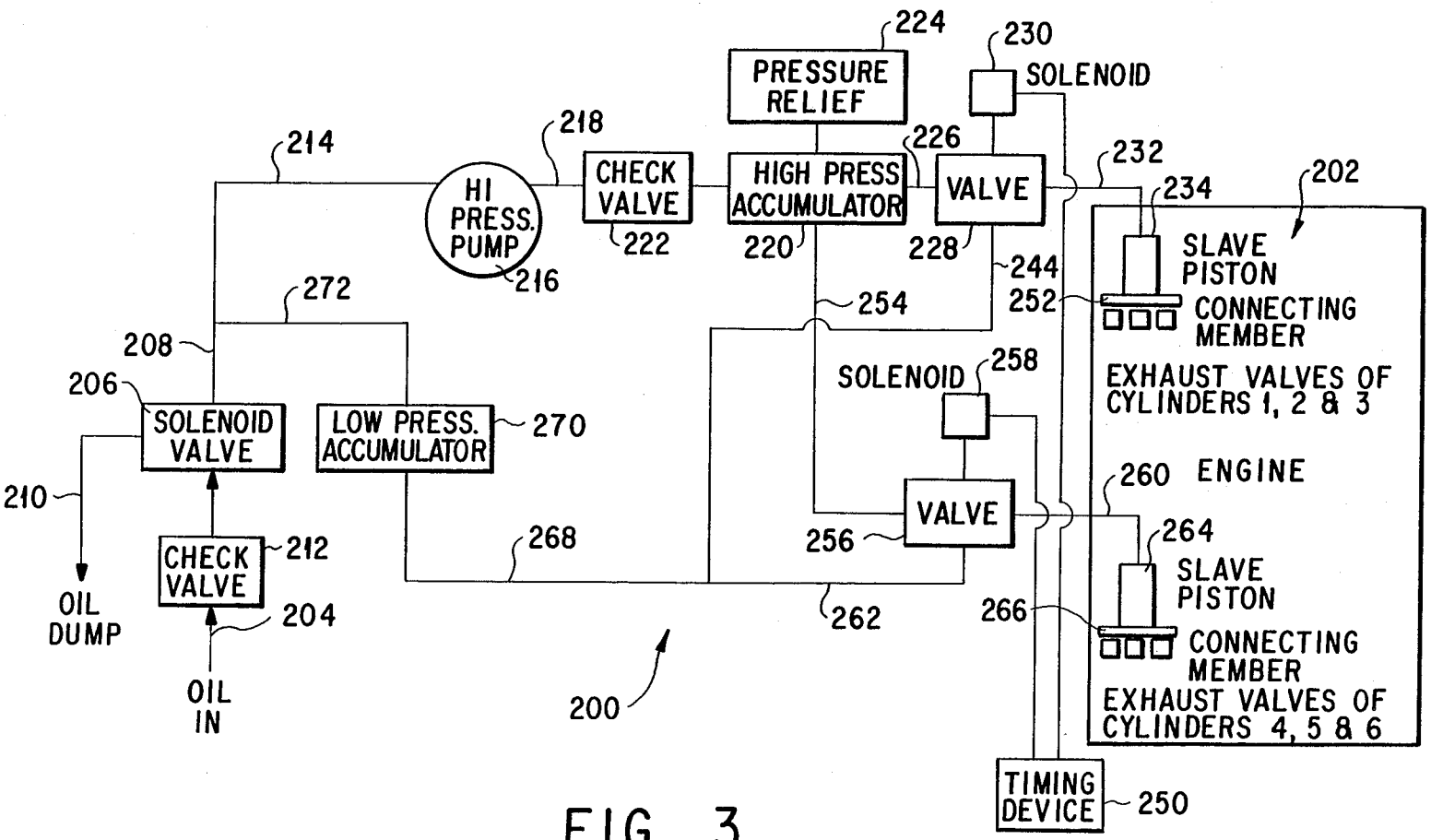
FIG. 3 is a diagrammatic view of a further embodiment of the engine retarding device.

FIG. 3 shows another, and preferred, embodiment of the invention represented by apparatus 200 for compression release retarding of a diesel engine 202 similar to the engine 12 shown in FIG. 1. The engine 202 has six cylinders numbered 1 through 6 in the conventional manner. A conduit 204 is connected to the oil pump of the engine for a supply of oil serving as an hydraulic fluid. The conduit extends to solenoid valve 206 which permits a flow of oil to conduit 208 when a control switch in the truck cab is actuated. When the apparatus is deactivated by opening the switch, a return flow of oil to the oil sump through conduit 210 occurs by action of solenoid valve 206. A check valve 212 positioned along conduit 204 is similar to valve 102 of FIG. 1 and allows a one-way flow of fluid through conduit 204 towards check valve 206 only. Conduit 208 is connected to a conduit 214 extending to the low pressure port of a high pressure hydraulic pump 216. This pump may be powered by a power take-off of the engine. The high pressure port of the pump is connected by a conduit 218 to a high pressure accumulator 220. A check valve 222 along conduit 218 prevents a return flow of fluid from accumulator 220 towards the pump. The accumulator is provided with a pressure relief device 224 which allows for over-pressurization of the accumulator. The accumulator is connected by a conduit 226 to a three-way, two position valve 228 actuated by a solenoid 230. A conduit 232 connects valve 228 to a slave cylinder/piston combination 234.

Figure 5:
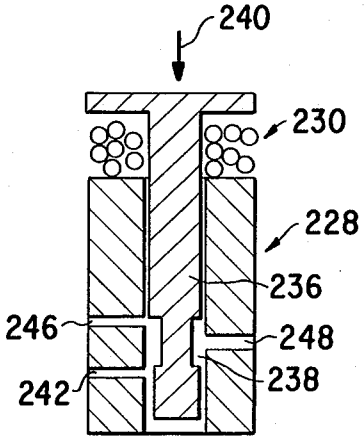
FIG. 5 is a diametrical section of an alternative solenoid operated release valve.

FIG. 5 shows valve 228 in more detail. Valve member 236 is cylindrical with an annular groove 238 and is moveable, by means of solenoid 230, in the direction indicated by arrow 240. Conduit 226 from the accumulator is connected to port 242 while return conduit 244 is connected to port 246. Port 248 is connected to conduit 232. In the normal position, when the solenoid is de-activated, the valve is in the position shown in FIG. 5 so conduit 232 communicates with conduit 244 for a return flow of fluid through port 248 past annular recess 238 and out through port 246. Solenoid 230 is activated by an electronic timing device 250 which moves valve number 238 downwardly from the point of view of FIG. 5 to close port 246 and allow communication between ports 242 and 248 past annular recess 238. This permits a flow a hydraulic fluid from conduit 226 towards conduit 232. Slave piston 234 bears against connecting member 252 which, in turn, bears against the stems of the closed exhaust valves for cylinders 1, 2 and 3. Another conduit 254 extends from accumulator 230 to a valve 256 actuated by solenoid 258. Valve 256 and solenoid 258 are identical to valve 228 and solenoid 230 shown in FIG. 5. Valve 256 normally connects conduit 260 to conduit 262 to allow a return flow of fluid from slave piston 264 to conduit 262. When solenoid 258 is activated by timing device 250, pressurized hydraulic fluid from the accumular passes from conduit 254 to conduit 260 to crack open the closed exhaust valves of cylinders 4, 5 and 6 by means of connecting member 266.

Return conduits 244 and 262 are connected to a single conduit 268 which is connected to a low pressure accumulator 270. A conduit 272 connects the low pressure accumular to conduit 208. Thus low pressure hydraulic fluid returning from slave pistons 234 and 264 is stored in accumulator 270 and fed into the low pressure side of pump 216. Timing device 250 is a conventional device which synchronizes the actuation of valves 228 and 256 with the valve openings.

Apparatus 200 operates to crack open the exhaust valves in the same manner as the earlier embodiments described above. However, the timing is regulated by electronics acting on solenoid valves instead of relying on a synchronized hydraulic pulse generator or a mechanical valve actuated by engine valves as in the previous embodiments. Solenoid valve 206 when inactivated allows a return flow of fluid from accumulator 270 through conduits 272 and 208 to conduit 210 which dumps the oil back into the oil sump of the engine. When activated, as described above, by a conventional switch in the truck cab, the solenoid valve stops the return flow of fluid to conduit 210 and opens conduit 204 in communication with conduit 208. The low pressure oil is fed through conduit 214 to high pressure pump 216 which provides high pressure oil to high pressure accumulator 220. Thus a quantity of high pressure oil is available in accumulator 220 when the apparatus is operational. A timed release of high pressure oil from accumulator 220 is governed by the action of timing device 250 and valves 228 and 256 to crack open the exhaust valves to provide retarding of the engine. In this embodiment, as seen in FIG. 3, crossheads 252 and 256 in conjunction with slave pistons 234 and 264 provide means for cracking open the exhaust valves of three cylinders simultaneously. As already described above, this does not actually occur because the exhaust valve or valves of one of the three cylinders is actually held open by normal valve operation at the time the others are cracked open. Basically timing device 250 activates solenoids 230 and 258 to depress slave pistons 234 and 264 whenever the exhaust valve or exhaust valves of one cylinder are on the compression stroke and near the top dead centre position. When the truck driver wishes to stop the retarding action, the switch in the cab is opened and this de-activates solenoid valve 206 so a return flow of fluid occurs from low pressure accumulator 270, through conduits 272 and 208, through the valve to conduit 210.

Figure 4:
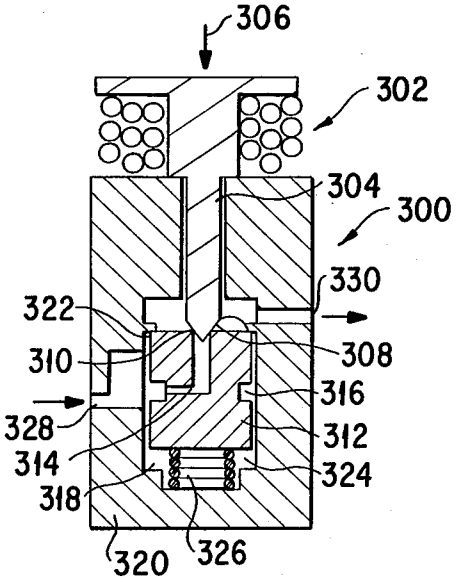
FIG. 4 is a diametrical section of a solenoid operated release valve for the apparatus.

FIG. 4 illustrates an alternative type of quick release valve. In this case, valve 300 is actuated by solenoid 302 and a suitable timing device. The solenoid moves a needle 304 in the downwards direction indicated by arrow 306 from the point of view of FIG. 4. The needle has a pointed tip 308 which mates with a valve seat 310 on a cylindrical valve member 312 when current is supplied to the solenoid 302. The valve member 312 has an internal passageway 314 which extends from valve seat 310 to annular groove 316 which extends about the valve member. The valve member 312 is capable of movement within cylindrical hollow 318 of valve body 320 between upper stop 322 and lower stop 324. In the position illustrated, valve member 312 is against upper stop 322 and held in this position by coil spring 326. The needle 304 has its end 308 closing off passageway 314. Thus a flow of oil is not possible between port 328 and port 330. However, when power to solenoid 302 is cut off, needle 304 is moved slightly, raising its end 308 off seat 310, allowing a flow of oil past the seat. The oil flows into port 328, enters cylindrical hollow 318 and passageway 314, flows past valve seat 310 into the upper part of cylindrical hollow 318 and leaves the valve through port 330. This valve is particularly suitable for rapid movement as required by the present invention in keeping with the fast action of valves. Only a very small movement of the solenoid is required to open the valve and discharge the high pressure fluid.

An electronic version of the embodiment shown in FIG. 2 may be derived by eliminating piston 174, cylinder 172, conduit 180, check valve 102.1 and conduit 173 between conduit 180 and check valve 178. Timing valve 152 is eliminated in favour of valve 300 shown in FIG. 4 and described above. Conduit 168 is connected to port 330 and conduit 144 is connected to port 328. Check valve 178 directly communicates with conduit 168 via the remaining portion of conduit 173 which by-passes valve 300. An electronic timing device, similar to device 250 of FIG. 3, is used to supply power to solenoid 302 to move needle 304 and allow a discharge of fluid from conduit 144 through valve 300 to conduit 168 and depress piston 66.1 at the proper time when one of the cylinders associated with exhaust valves 134 is on the compression stroke and near the top dead centre position. When the pressure in cylinders 118 and 112 drops due to closing of intake valves 132 and exhaust valves 134, a return flow of fluid from cylinder 68.1 through conduit 168 occurs through the remaining portion of conduit 173 to check valve 178, conduit 176, conduit 144 and back to the cylinders 118 and 112.

On some known conventional retarding devices, a fuel injector push tube or push rod is used to crack open each of the exhaust valves when the corresponding cylinder is on the compression stroke and near the top dead centre position. Some advantages of the invention may be realized by utilizing the same means, or an intake push tube, to crack open the exhaust valve or valves of a cylinder on the intake stroke while the exhaust valve of the cylinder of the compression stroke is open. This achieves the advantage described above whereby a pressure wave is generated in the exhaust manifold originating from the cylinder on the compression stroke and which may be deflected into the cylinder on the intake stroke by opening its exhaust valve at the appropriate time. This effect may be enhanced, as described above, by partially blocking the exhaust system. The effect is to increase the compression of the cylinder on the intake stroke, thereby increasing the braking effect when this cylinder reaches the compression stroke.

The invention provides a simplified system, wherein a plurality of exhaust valves can be opened at the same time instead of requiring individual timing for each valve. As shown in FIG. 1, only two hydraulic lines are required for the slave pistons of a six cylinder engine. As well, the cylinders associated with the same hydraulic line, and the same slave piston in the case of the embodiment of FIG. 1, are conveniently the two juxtaposed groups of cylinders 1, 2 and 3, and 4, 5 and 6, for a conventional six cylinder, in-line engine. As shown in FIG. 1, the device also operates on the position of the exhaust valve of the cylinder on the exhaust stroke, but has no real effect because this valve is already open by the push rod and rocker arm of the engine in a conventional manner.

The operation of the device, as far as the truck driver is concerned, is essentially the same as the prior art. As might be expected, the truck driver removes his foot from the accelerator to reduce the fuel intake of the engine. A switch in the cab is activated to open the solenoid valve 100, 100.1 or 206 as described above. This serves to crack open the exhaust valves of each of the cylinders on each compression stroke near the top dead centre position and simultaneously crack open the exhaust valves of another cylinder during its intake stroke. Although this simultaneous opening, and subsequent closing of these two exhaust valves is achieved by the apparatuses disclosed, it may be desirable to crack open the exhaust valve of the cylinder on the intake stroke slightly after the exhaust valve of the cylinder on the compression stroke to allow for the time it takes the pressure wave to move from the latter to the former. Some of the simplicity of the structure is lost however if provision must be made to open these valves at different times.

It should be understood that many of the stated configurations and details provided above are specific to the preferred embodiments which are provided by way of example. The scope of the invention is to determine by a set of claims which follow.

What is claimed is:

1. A method for compression release retarding of a four cycle, multi-cylinder internal combustion engine with first and second cylinders having exhaust outlets communicating with a common manifold and wherein the piston of the second cylinder is on its intake stroke while the piston of the first cylinder is near top dead centre of a compression stroke, the method comprising the steps of:

reducing the fuel intake of the engine;

opening an exhaust valve of the first cylinder each time the first cylinder is near top dead centre of the compression stroke; and opening an exhaust valve of the second cylinder during the intake stroke of the second cylinder while the exhaust valve of the first cylinder is open said each time.

2. A method as claimed in claim 1, further comprising the step of restricting the flow of exhaust gases from the engine.

3. A method as claimed in claim 1, wherein said exhaust valve of the first cylinder and said exhaust valve of the second cylinder are closed after a relatively short time.

4. A method of compression release retarding of a six cylinder, four cycle engine having two groups of three cylinders wherein each group has, when a first cylinder of the said each group is near top dead centre of a compression stroke, a second cylinder on an intake stroke and a third cylinder on an exhaust stroke, the method comprising the steps of:

reducing the intake of fuel into the engine;

opening an exhaust valve of the first cylinder a relatively small amount each time the first cylinder is near said top dead centre position of a compression stroke; and simultaneously opening an exhaust valve of the second cylinder while an exhaust valve of the third cylinder is open normally on said exhaust stroke.

5. A method for compression release retarding of a multi-cylinder, internal combustion engine, comprising;

opening at least one exhaust valve of a first said cylinder of the engine for a short period of time beginning each time the piston of the first cylinder is on a compression stroke near top dead centre; and opening at least one exhaust valve of a second said cylinder of the engine while the at least one exhaust valve of the first cylinder is so open and while the second cylinder is on an intake stroke.

6. An apparatus for compression release retarding of a four cycle, multi-cylinder, internal combustion engine, comprising:

means for opening an exhaust valve of a first cylinder of the engine for a short period of time near the top dead centre position during a compression stroke; and means for opening an exhaust valve of a second cylinder of the engine while the second cylinder is on an intake stroke and while said exhaust valve of the first cylinder is open during the period of time.

7. An apparatus for compression release retarding of a four cycle, multi-cylinder, internal combustion engine, wherein each said cylinder has a piston and at least one exhaust valve and at least one intake valve, the apparatus comprising:

means for opening said at least one exhaust valve of each of a plurality of said cylinders of the engine for a period of time beginning near the top dead centre position at the end of a compression stroke of one of said plurality of cylinders and while another of said plurality of cylinders is on an intake stroke.

8. An apparatus as claimed in claim 7, wherein the means for opening is operable on the exhaust valves of three cylinders of the engine, a third of the three cylinders being on an exhaust stroke during said period of time.

9. An apparatus as claimed in claim 8, wherein the engine has six cylinders and the apparatus includes two said means for opening, each said means for opening being operable on the exhaust valves of three of the cylinders.

10. An apparatus as claimed in claim 7, wherein the means for opening includes a valve depressing hydraulic actuator capable of optionally depressing said exhaust valve of each of the plurality of cylinders a small distance relative to normal, maximum valve movement for a relatively short period of time during each cycle of said each plurality of cylinders.

11. An apparatus as claimed in claim 10, wherein the means for opening includes means for supplying pressurized fluid to the valve depressing hydraulic actuator at the beginning of said period of time.

12. An apparatus as claimed in claim 11, wherein the means for supplying includes an hydraulic pump and means for operating said hydraulic pump to supply the pressurized fluid during said period of time.

13. An apparatus as claimed in claim 12, wherein the means for supplying further includes a conduit extending between the hydraulic pump and said hydraulic actuator.

14. An apparatus as claimed in claim 13, wherein the pump is a master cylinder, the actuator being a slave cylinder and the means for supplying further comprises a rotatable cam and a cam follower operatively connected to a piston of the master cylinder, the cam having lobes shaped and located to depress said master cylinder piston when the piston of any of the plurality of engine cylinders is near the top dead centre position at the end of a compression stroke.

15. An apparatus as claimed in claim 14, wherein the cam is operatively connectable to a power take-off for the engine and comprises an hydraulic pulse generator.

16. An apparatus as claimed in claim 15, wherein the engine has a valve cover mount, the apparatus further comprising a housing connectable to the valve cover mount enclosing at least part of the means for opening.

17. An apparatus as claimed in claim 11, wherein the means for supplying includes means for storing pressurized hydraulic fluid, a first hydraulic fluid conduit extending from the means for storing to the valve depressing hydraulic actuator and means along the first conduit for providing a release of the pressurized hydraulic fluid through the first conduit towards the valve depressing hydraulic actuator when any of the plurality of cylinders is near the top dead centre position at the end of a compression stroke.

18. An apparatus as claimed in claim 17, wherein the means for supplying includes a hydraulic fluid pumping means for providing pressurized hydraulic fluid to the means for storing.

19. An apparatus as claimed in claim 18, wherein the pumping means is actuated by valve opening components of the engine.

20. An apparatus as claimed in claim 19, wherein the plurality of cylinders comprises three cylinders, a third of said three cylinder being on an exhaust stroke during said period of time, the pumping means being actuated by valve opening components for the intake valves and for the exhaust valves of the three cylinders for pumping hydraulic fluid into the means for storing prior to a release of pressurized fluid, by said means for providing a release of the pressurized hydraulic fluid, when the piston of any of said three cylinders is near said top dead centre position at the end of a compression stroke.

21. An apparatus as claimed in claim 20, wherein the means for providing a release of the pressurized hydraulic fluid includes means for timing the release of hydraulic fluid so the release occurs near the top dead centre position of any of the three cylinders at the end of a compression stroke, the means for timing including a timing valve along the first hydraulic fluid conduit.

22. An apparatus as claimed in claim 21, wherein the timing valve is activated by a timing valve actuator responsive to movement of the valve opening components of the engine.

23. An apparatus as claimed in claim 20, wherein the timing valve has a timing valve hydraulic actuator operatively associated with the timing valve, the means for timing further including control means operatively connected to the valve opening components for the exhaust valves of the three cylinders for supplying pressurized hydraulic fluid to the timing valve hydraulic actuator to open the timing valve and release hydraulic fluid towards the valve depressing hydraulic actuators as any of the exhaust valves of the three cylinders is opened by the valve opening components of the engine.

24. An apparatus as claimed in claim 23, wherein the control means is a master cylinder operatively connected to the valve opening components for the exhaust valves.

25. An apparatus as claimed in claim 23, wherein the control means and the timing valve actuator are master and slave hydraulic cylinders fitted with pistons and interconnected by a second hydraulic fluid conduit.

26. An apparatus as claimed in claim 25, wherein the timing valve comprises the piston and cylinder of the timing valve actuator and ports communicating with the timing valve cylinder and connected to a first portion of said first hydraulic conduit which is connected to said valve depressing hydraulic actuator and to a second portion of said first hydraulic fluid conduit connected to the means for storing pressurized hydraulic fluid, the piston of the timing valve actuator being biased to a position blocking a flow of hydraulic fluid between the portions of the first hydraulic fluid conduit and being movable to a position to permit communication between the portions of the first hydraulic fluid conduit through the cylinder of the timing valve actuator when pressurized hydraulic fluid is supplied to the timing valve cylinder from said timing valve master cylinder.

27. An apparatus for compression release retarding of a four cycle, multi-cylinder, internal combustion engine wherein each said cylinder has a piston, one or more intake valves and one or more exhaust valves and a valve cover position; the apparatus comprising:

a housing means for fitting on the valve cover position of the engine;

means in the housing for simultaneously opening closed said exhaust valves of a set of said cylinders during a period of time beginning each time the piston of any cylinder of the set is on a compression stroke and near the top dead centre position, the piston of at least one other cylinder of the set being on an intake stroke and the set of cylinders being selected so that, during the period of time, the pistons of all said cylinders of the set are on the intake stroke, on the exhaust stroke, or are on the compression stroke and near top dead centre position.

28. An apparatus as claimed in claim 27, wherein the engine has a common exhaust manifold for the plurality of cylinders, the apparatus further comprising means for restricting the flow of exhaust gases from the common exhaust manifold during the period of time.

29. An apparatus as claimed in claim 28, wherein the means for restricting include a valve having a member movable into a position to partially block the flow of exhaust gases from the common exhaust manifold during the period of time.

30. In combination:

a four cycle, multi-cylinder, internal combustion engine wherein each said cylinder has a piston, one or more intake valves and one or more exhaust valves; and an apparatus for compression release retarding of the engine, including means for selectively opening, during a common period of time, one or more said exhaust valves of each of two said cylinders each time a first of said two cylinders is on a compression stroke and near a top dead centre position and when a second of said two cylinders is on an intake stroke.

31. In combination:

a four cycle, multi-cylinder, internal combustion engine having a crankshaft and wherein each said cylinder has a piston, one or more intake valves and one or more exhaust valves; and an apparatus for compression release retarding of the engine operatively connected to the engine and including first means for selectively opening one or more normally closed said exhaust valves of each of two said cylinders each time a first of said two cylinders is on a compression stroke near a top dead centre position and so said normally closed exhaust valves of said each two cylinders are open during a common period of time.

32. A combination as claimed in claim 31, wherein the means for opening includes means for opening the exhaust valves of a second of said two cylinders while the second cylinder is on an intake stroke.

33. A combination is claimed in claim 31, wherein the means for opening includes means simultaneously operable on the exhaust valves of three said cylinders for simultaneously opening the exhaust valves of any of the three cylinders which are closed during said period of time.

34. A combination as claimed in claim 31, wherein the means for opening includes means simultaneously operable on the exhaust valves of three said cylinders for simultaneously opening the closed exhaust valves of two of said three cylinders, a first of two cylinders being on a compression stroke near a top dead centre position, a second of said two cylinders being on an intake stroke and a third of said three cylinders being on an exhaust stroke and having said one or more exhaust valves of said third cylinder normally open during said period of time.

35. A combination as claimed in claim 31, wherein the engine has at least one exhaust manifold, the exhaust valves of said two cylinders communicating with a common said exhaust manifold.

36. A combination as claimed in claim 35, further including means for restricting the flow of exhaust gases from said exhaust manifold.

37. A combination as claimed in claim 31, wherein said means for opening includes at least one hydraulic actuator operatively communicating with said one or more exhaust valves of each of said two cylinders.

38. A combination as claimed in claim 37, wherein the means for opening includes means for supplying pressurized fluid to said at least one hydraulic actuator during said period of time.

39. A combination as claimed in claim 38, wherein the means for opening includes an hydraulic pulse generator hydraulically connected to said at least one hydraulic actuator and positively driven in syncronization with said crankshaft.

40. A combination as claimed in claim 38, wherein the means for opening includes means for storing pressurized hydraulic fluid, a conduit extending from the means for storing to said at least one hydraulic actuator and means for providing a release of the pressurized hydraulic fluid through the conduit to said at least one hydraulic actuator at the beginning of the period of time.

41. A combination as claimed in claim 40, wherein the means for providing a release of the pressurized fluid includes a valve with a solenoid operated actuator.

42. A combination as claimed in claim 31, wherein the engine has six cylinders with first and second sets of three cylinders, each of said sets of three cylinders having a first cylinder on an intake stroke and a second cylinder on an exhaust stroke when a third cylinder is on a compression stroke near a top dead centre position, said first means for opening operatively communicating with said exhaust valves of the first set of three cylinders to open the closed exhaust valves of the first set of cylinders when any of the cylinders of the first set is on the compression stroke near the top dead centre position, the combination further including a second means operatively communicating with the one or more said exhaust valves of each said cylinder of the second set of cylinders for opening the normally closed exhaust valves of the second set of cylinders each time any of the cylinders of the second set is on the compression stroke near the top dead centre position.

* * * * *

UNITED STATES PATENT AND TRADEMARK OFFICE

CERTIFICATE OF CORRECTION

PATENT NO. : 4,741,307

DATED : May 3, 1988

INVENTOR(S) : Vincent A. Meneely

It is certified that error appears in the above-identified patent and that said Letters Patent is hereby corrected as shown below:

On the title page assignee should read

--(73)Assignee: Pacific Diesel Brake Co., --.

Signed and Sealed this

Eleventh Day of October, 1988

*Attest:*

DONALD J. QUIGG

*Attesting Officer*

*Commissioner of Patents and Trademarks*